US006524197B2

(12) United States Patent
Boone

(10) Patent No.: US 6,524,197 B2
(45) Date of Patent: Feb. 25, 2003

(54) GOLF CLUB HEAD HAVING A DEVICE FOR RESISTING EXPANSION BETWEEN OPPOSING WALLS DURING BALL IMPACT

(75) Inventor: David D. Boone, El Toro, CA (US)

(73) Assignee: Zevo Golf, Temecula, CA (US)

( * ) Notice: Subject to any disclaimer, the term of this patent is extended or adjusted under 35 U.S.C. 154(b) by 0 days.

(21) Appl. No.: 09/854,322

(22) Filed: May 11, 2001

(65) Prior Publication Data

US 2002/0169036 A1 Nov. 14, 2002

(51) Int. Cl.[7] ..... A63B 53/04; A63B 53/06
(52) U.S. Cl. ..... 473/324; 473/346; 473/349
(58) Field of Search ..... 473/324, 345, 473/346, 329, 350, 349, 242, 226, 231, 338, 339, 244

(56) References Cited

U.S. PATENT DOCUMENTS 2,175,598 A * 10/1939 Fedak
3,567,228 A * 3/1971 Lynn
3,589,731 A * 6/1971 Chancellor
4,067,572 A * 1/1978 Coleman
4,313,607 A * 2/1982 Thompson
4,535,990 A * 8/1985 Yamada
4,602,787 A * 7/1986 Sugioka
4,877,249 A * 10/1989 Thompson
5,000,454 A * 3/1991 Soda
5,429,365 A * 7/1995 McKeighen
5,464,211 A * 11/1995 Atkins
5,890,973 A * 4/1999 Gamble

* cited by examiner

*Primary Examiner*—Sebastiano Passaniti
(74) *Attorney, Agent, or Firm*—Leonard Tachner

(57) ABSTRACT

An improved golf driver club head wherein each driver club head has a tensioning device, which places the peripheral/outer structure of the club head in compression; thereby, resulting in a stronger, more rigid club head structure. In the preferred embodiment, the tensioning device comprises an elongated cylindrical member having respective end members. The top and bottom surfaces of the golf club head are each provided with a cylindrical depression or recess and an aperture or passage at the lower end of the depression. The passages are just large enough to accommodate the tensioning device, but are too small to pass the respective end members. During club head manufacture, the length of the device is selected to apply a compressive force between the head surfaces. Fine adjustment is accommodated by a threaded end member. The actual compression force may be selected to yield the best performance depending on the geometry, structure and material of the club head.

8 Claims, 4 Drawing Sheets

GOLF CLUB HEAD HAVING A DEVICE FOR RESISTING EXPANSION BETWEEN OPPOSING WALLS DURING BALL IMPACT

BACKGROUND OF THE INVENTION

1. Field of the Invention

The present invention relates generally to the field of golf club heads and more specifically to a golf club wood-type head having a tensioning device for better energy transfer.

2. Background Art

Golf club wood heads that are made from metal (metal woods) and other more exotic high technology materials have distinct advantages over wooden club heads. Generally wooden golf club heads are less durable, vary in density and hardness and require great expertise through the manufacturing process. Metal and exotic materials woods on the other hand can be replicated consistently from the original design, use strong durable materials and are produced using proven manufacturing processes.

Metal and exotic material woods out-perform wooden clubs because they use harder, stronger materials. The use of these materials enables the weight to be transferred to the club head perimeter thereby stabilizing the club head as it comes into impact with the golf ball. Stabilizing the club head at impact reduces the characteristic oscillations that occur to the club head on the golfer's down swing, resulting in a more efficient transfer of energy to the golf ball. The increased (more efficient) transfer of energy results in additional ball travel distance. Another benefit from a more stable club head is accuracy. If the club head is more stable at impact, less oscillation will occur during impact. This produces less spin to the golf ball and reduces deflection of the club head resulting in straighter shots.

Over the last decade golf club manufacturers have increased the size of metal wood driver club heads. This has happened for two basic reasons: One, golfers are always searching for ways to hit the golf ball longer and straighter. Larger club heads are more stable during impact and are easier to hit, resulting in consistently longer straighter hits. Two, manufacturing methods have improved, allowing the development of larger metal wood driver club heads utilizing extremely thin wall casting or forgings in the structure and in high performance materials such as titanium.

Regardless of manufacturer, most driver club head weights are within a few grams of each other. Typical driver club head weights will range from approximately 192 grams to 202 grams depending on club length, shaft type and manufacturer specifications. Generally, the club head will remain as a constant in order to provide proper balance, physical and mechanical properties which combine to produce a well performing golf club.

Metal wood (driver) club heads utilize thin wall castings or forgings to achieve their size, shape and weight. The larger the driver club head, the thinner the castings or forgings that are required to produce the intended resulting driver club head.

When a driver club head comes into contact with the golf ball, which is stationary, during the golf swing, the resultant collision, depending on the impact velocity and angle of attack, causes the golf ball to compress on the one hand and the driver club head to deform on the other.

The amount of deformation that occurs to the driver club head during impact with the golf ball depends on, but is not limited to the following criteria:

1. The size of the driver club head;
2. The material used to construct the driver club head;
3. The design and construction of the driver club head;
4. The wall thickness of the driver club head;
5. The velocity of the driver club head as it comes into contact with the golf ball;
6. The angle of attack at which the driver club head impacts the golf ball;
7. The distribution of mass within the club head;
8. The mass (weight) of the club head;
9. The stiffness of the club head structure;
10. The strength of the club head structure.

As driver club heads become larger, their ability to prevent deformation at impact with the golf ball becomes more difficult. Even with the use of high performance materials such as titanium or carbon fiber, the weight constraints common in most driver club heads make it imperative to design driver club heads using thin walls. As the driver club head comes into contact with the stationary golf ball during the downswing, the driver club head will oscillate and deform in an effort to find its way around the stationary golf ball. The golf ball compresses under the load during said impact with the club head initiating a lateral direction change of the golf ball away from the center of gravity of the club head resulting in the golf ball rolling in the direction of least resistance prior to the initiation of the rebound phase of the golf ball during impact with the club head. During this impact process, the stored energy that normally would be directed from the driver club head to the golf ball is momentarily redirected to the driver club head. The resulting redirection of energy transfer causes the driver club head structure to flex and deform. This occurrence constitutes a loss of energy that could be imparted from the driver club head to the golf ball. The resulting loss of energy from the driver club head to the golf ball during impact will result in a reduction of energy that can be transferred from the club head to the golf ball resulting in a loss of distance that the golf ball will travel.

SUMMARY OF THE INVENTION

The present invention comprises an improved golf driver club head wherein each driver club head has a tensioning device which places the peripheral/outer structure of the metal wood club head in compression thereby resulting in a stronger more rigid metal wood club head structure.

This is accomplished by affixing the tensioning device to the crown (top) surface of the metal wood club head and to the sole (bottom) surface of the metal wood club head. The device is affixed to the two surfaces of the metal wood club head and is pre-tensioned. The tensioning is accomplished by compressing the two metal wood club head surfaces together then affixing the device to the opposed surfaces so that the surfaces are held in state of relative compression. Another way this can be accomplished is to affix the device to the two metal wood club head surfaces either through a hole or boss and to adjust the device by compressing, rotating (screwing), gluing or other form of fastening.

In the preferred embodiment illustrated herein by way of example, the tensioning device comprises an elongated cylindrical member having respective end members. The top and bottom surfaces of the golf club head are each provided with a cylindrical depression or recess and an aperture or passage at the lower end of the depression. The passages are just large enough to accommodate the tensioning device, but are too small to pass the respective end members. During club head manufacture, the length of the device is selected to apply a compressive force between the head surfaces which may preferably be in the range of one pound to three hundred pounds. The actual compression force may be selected to yield the best performance depending on the actual geometry, structure and material of the club head.

While the applicant is not the first to recognize the potential positive effect of a tensioned golf club head (see for example, prior art U.S. Pat. No. 5,501,453), applicant is believed to be the first to employ a tensioning device within the head cavity and the first to compress the top and bottom head surfaces toward one another to resist their further separation during ball impact.

OBJECTS OF THE INVENTION

It is therefore a principal object of the present invention to provide a metal wood golf club head having a tensioning device to resist expansion between the top and bottom surfaces of the head during impact with the golf ball.

It is another object of the invention to provide a metal wood golf club head having a tensioning device positioned inside the head for compressing the top and bottom head surfaces in the nominal condition of the club head.

It is yet another object of the invention to interconnect the interior top and bottom surfaces of a metal wood golf club head by a tensioning wire which resists separation of those surfaces during ball impact.

It is still another object of the invention to provide a method for compressing two opposing walls of a golf club metal wood head toward each other to resist their further separation at ball impact.

It is still another object of the invention to improve the performance of a golf club having a metal wood head by employing a tensioning device to compress two opposing walls of the head and thereby resist deformation of the head at ball impact.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
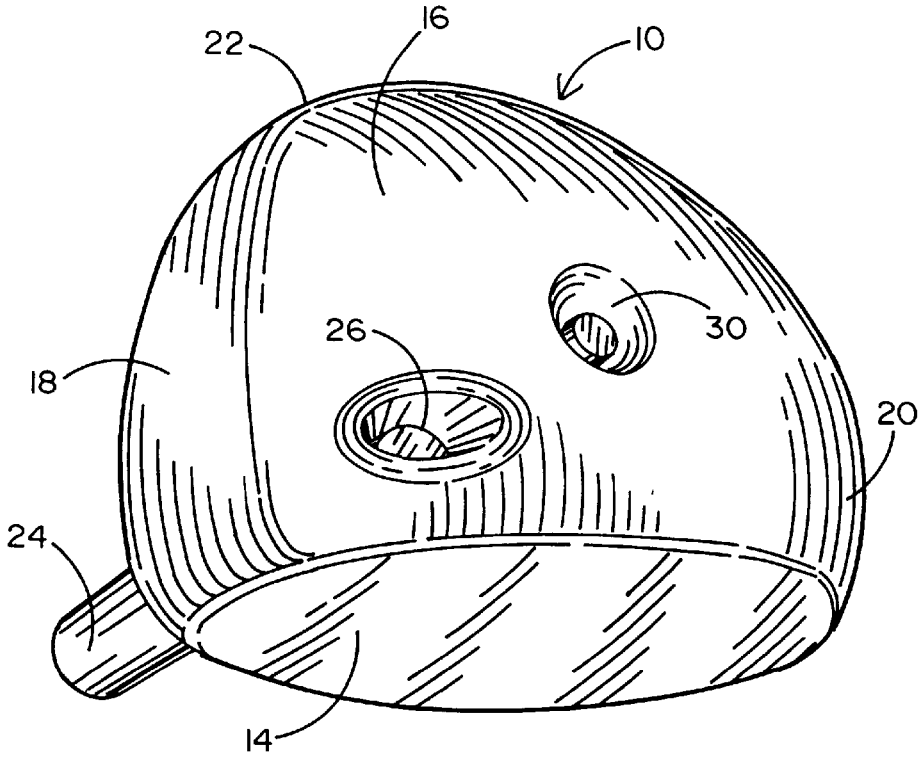
FIG. 1 is a three-dimensional view of a preferred embodiment of the invention taken from the face and sole intersection.
Figure 2:
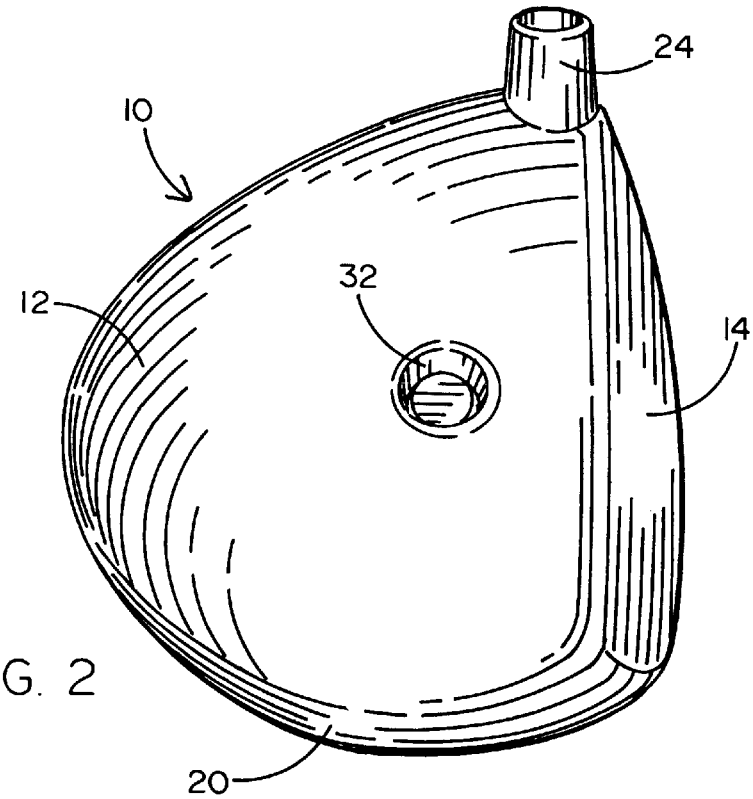
FIG. 2 is another three-dimensional view of the preferred embodiment, but taken from the face and crown intersection.
Figure 3:
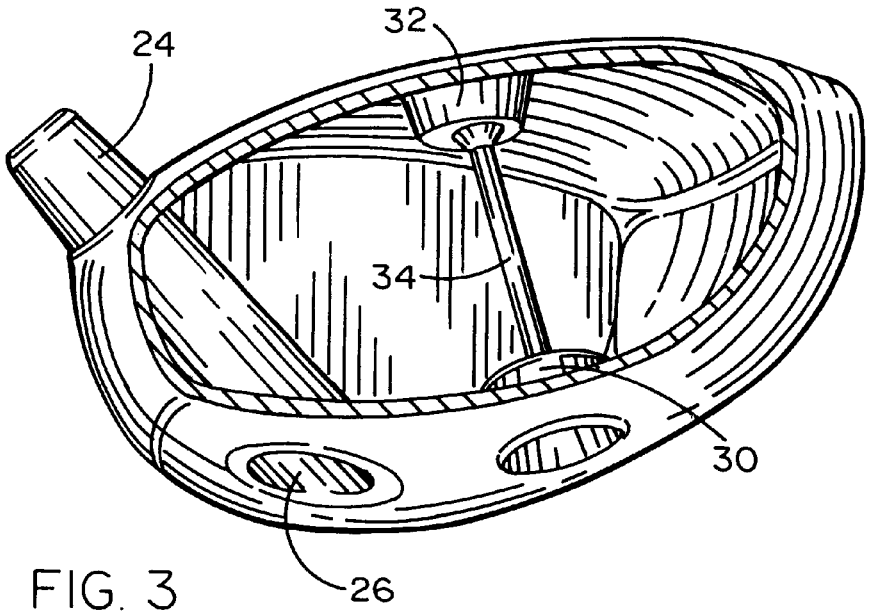
FIG. 3 is a partially cut-away view of the preferred embodiment taken from the rear surface of the head.
Figure 4:
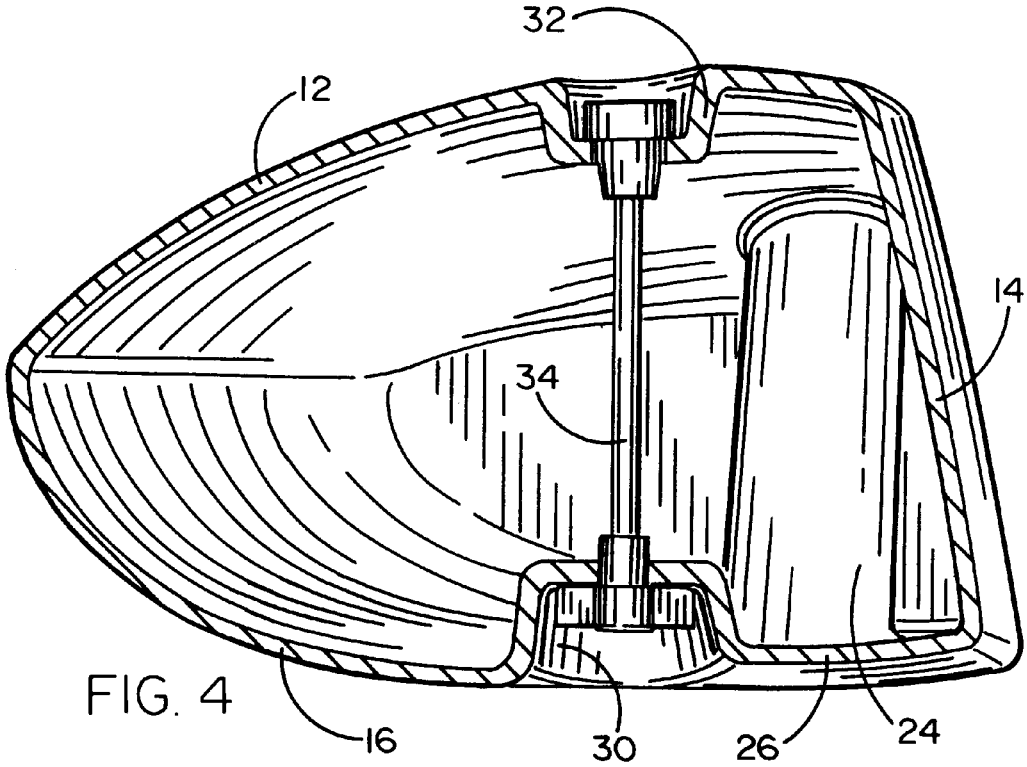
FIG. 4 is a completely cut-away view taken from the toe of the head.
Figure 5:
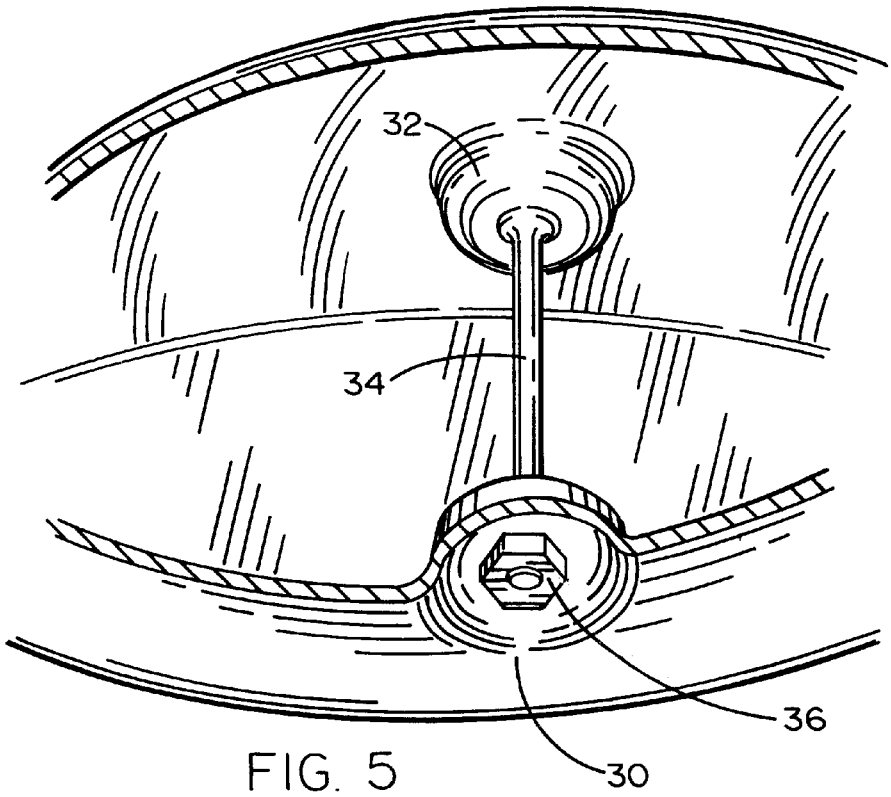
FIG. 5 is a cut-away view showing the tensioning device connection to the sole.
Figure 6:
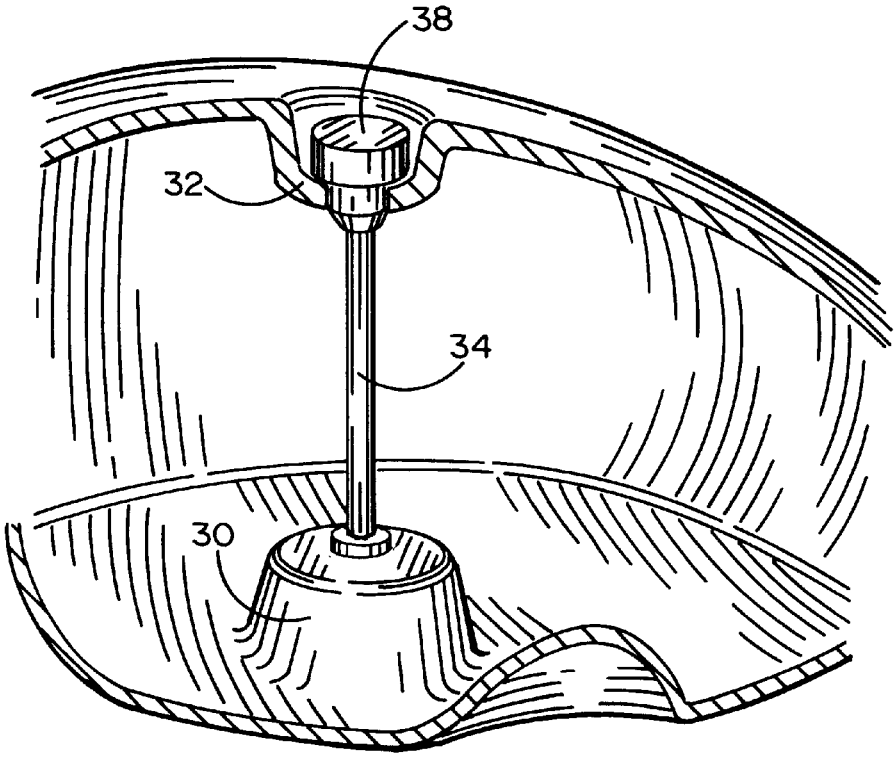
FIG. 6 is a cut-away view showing the tensioning device connection to the crown.
Figure 7:
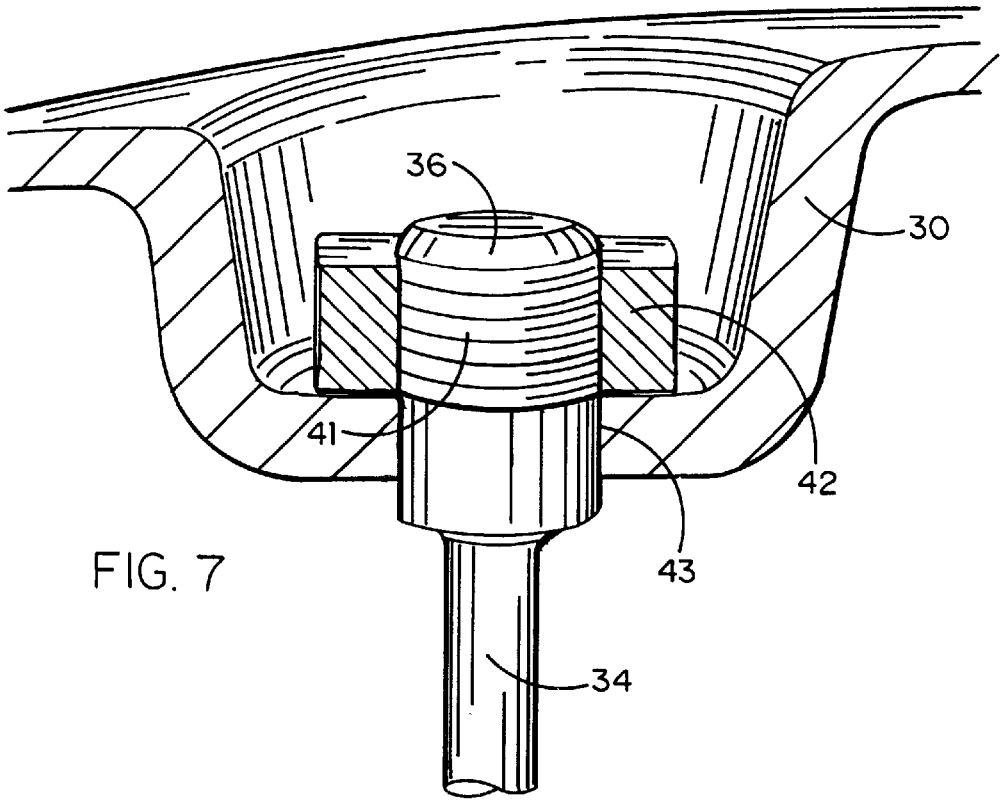
FIG. 7 is an enlarged cross-sectional view of the tensioning device sole connection.
Figure 8:
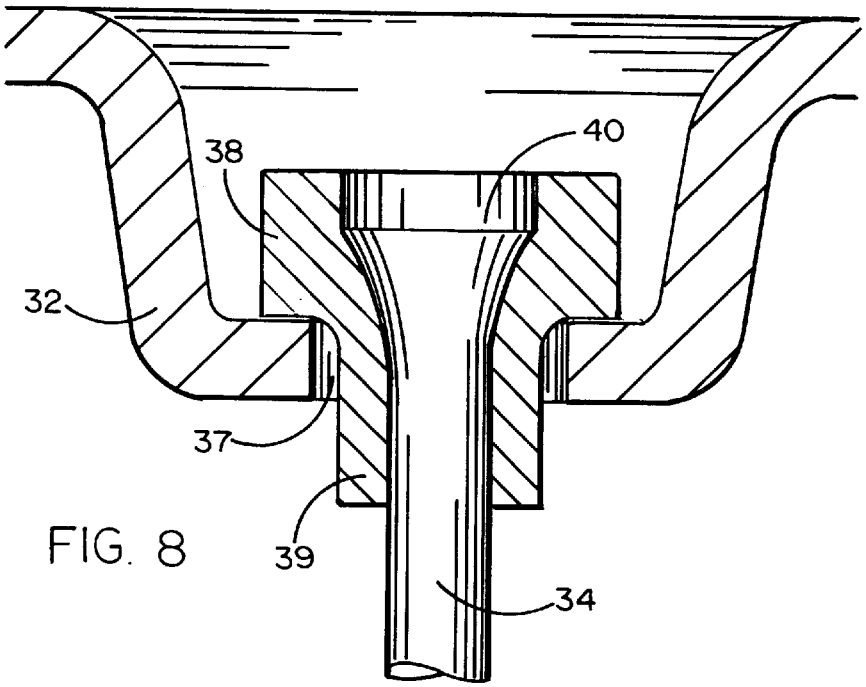
FIG. 8 is an enlarged cross-sectional view of the tensioning device crown connection.

Referring to the accompanying drawings, it will be seen that a preferred embodiment of a golf cub metal wood head 10 comprises a top or crown 12, a face or hitting surface 14, a bottom or sole 16, a heel 18, a toe 20, a back 22 and a hosel 24. These various surfaces are generally configured as in typical driver heads forming a conventionally shaped golf club head. Hosel 24 extends into the interior of the head 10 and to the sole 16 forming a hosel/sole aperture 26 as seen in FIGS. 1 and 4.

Unlike conventional driver heads, the head 10 of the illustrated embodiment provides a sole recess 30 and a crown recess 32 at opposing locations on sole 16 and crown 12, respectively. Moreover, the present invention provides a tensioning device 34 which extends internally of head 10 between the sole recess 30 and the crown recess 32. Tensioning device 34 may be any high strength, lightweight, elongated member (i.e., wire) that can withstand tension forces exceeding at least several hundred pounds. Various materials may be suitable for use as tensioning member 34 including a metal such as steel or titanium, an alloy of iron or titanium, a fiber composite or a matrix of carbon fiber and material such as metals, ceramics and the like. The device 34 may be in the form of a multi-strand wire, a solid elongated bar or a hollow tube.

In the preferred embodiment illustrated in FIGS. 3–8, tensioning device 34 has respective end members 36 and 38 at the sole and crown, respectively. End member 38 is inserted through an aperture 37 in crown recess 32 and is of sufficient size to rest at the base of the recess without falling through the aperture. End member 38 has an integral ferrule 39 of smaller diameter which extends through aperture 37 to concentrically engage tensioning device 34. End member 38 is retaining on device 34 by a secure engagement with an expanded or swaged terminus 40 of device 34. End member 36 is secured in sole recess 30 through an aperture 43. A threaded portion 41 and tensioning nut 42 assure a secure entrapment of the end member while providing a convenient tension adjustment access during manufacture of the head 10.

It will be understood that the actual amount of pre-tensioning between crown 12 and sole 16 is adjustable in the illustrated embodiment and that the precise amount of such tension, while likely to be in the range of 1 lb. to 300 lbs., is dependent on various factors relating to the head 10. Such factors include, head shape and geometry, wall material and thickness and the degree of desired performance improvement. It will also be understood that the invention is designed to resist further separation of the sole and crown at impact with a golf ball so that less energy is dissipated in head deformation and more energy is transferred to the ball. Other opposing walls of a golf club metal wood head may be provided with a tensioning device to prevent their respective further separation at ball impact. Moreover, the invention herein is not limited to golf clubs made of metal, but may also be used on golf club heads made of more exotic materials such as fiber composites and the like.

Having thus disclosed a preferred embodiment of the invention, it being understood that numerous modifications and additions are contemplated and that the scope of protection hereof is limited only by the appended claims and their equivalents, I claim:

What is claimed is:

1. A golf club head having a sole, a crown, a toe, a heel and a hitting surface all forming an interior cavity and being connectable to a golf club shaft by an integral hosel, the head comprising:

a tensioning member located in the interior cavity between apertures at opposing locations on the sole and crown for increasing compression therebetween and being affixed at respective ends to said opposing locations, said tensioning member being in a state of selected tension to apply a selected compressive force between said sole and said crown.

2. The golf club head recited in claim 1 wherein said compressive force is in a range of from about one pound to about three hundred pounds.

3. The golf club head recited in claim 1 wherein said tensioning member has an elongated cylindrical shape.

4. The golf club head recited in claim 1 wherein said tensioning member comprises at least one material take from the group consisting of:

metal, carbon fiber and ceramic.

5. The golf club head recited in claim 1 wherein at least one end of said tensioning member comprises an adjustable portion for modifying said compressive force.

6. A method for configuring a golf club head for increased compression and thus resisting deformation between two opposing walls defining an internal cavity, the deformation occurring upon impact with a golf ball; the method comprising the steps of:

a) positioning an elongated tensioning device between apertures at said opposing walls within said internal cavity;

b) attaching the respective ends of said tensioning device to said opposing walls; and c) applying a selected tensioning force to said tensioning device to compress said opposing walls toward each other.

7. The method recited in claim 6 further comprising the steps of shaping at least one of said opposing walls to form a recess extending into said cavity; and providing an aperture in said recess for capturing one of said respective ends.

8. The method recited in claim 6 wherein said opposing walls are the crown and the sole of said head.

* * * * *